US009352581B2

(12) United States Patent
Shoda et al.

(10) Patent No.: US 9,352,581 B2
(45) Date of Patent: May 31, 2016

(54) DECOLORING APPARATUS FOR READING SHEET AFTER DECOLORING IMAGE

(71) Applicants: KABUSHIKI KAISHA TOSHIBA, Tokyo (JP); TOSHIBA TEC KABUSHIKI KAISHA, Tokyo (JP)

(72) Inventors: Hirokazu Shoda, Yokohama Kanagawa (JP); Yusuke Hashizume, Urayasu Chiba (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 35 days.

(21) Appl. No.: 14/289,606

(22) Filed: May 28, 2014

(65) Prior Publication Data

US 2015/0343794 A1 Dec. 3, 2015

(51) Int. Cl.
*B41M 7/00* (2006.01)
*B41J 2/32* (2006.01)

(52) U.S. Cl.
CPC ..... *B41J 2/32* (2013.01); *B41M 7/0009* (2013.01); *B41M 7/009* (2013.01)

(58) Field of Classification Search
USPC ..... 347/179
See application file for complete search history.

(56) References Cited

U.S. PATENT DOCUMENTS

| | | | | |
|---|---|---|---|---|
| 8,890,912 | B2 * | 11/2014 | Taki et al. | 347/179 |
| 8,958,135 | B2 * | 2/2015 | Saito | 358/488 |
| 2012/0036985 | A1 * | 2/2012 | Ruhlman et al. | 86/56 |
| 2012/0257264 | A1 * | 10/2012 | Megawa | 358/505 |
| 2012/0306982 | A1 * | 12/2012 | Taki et al. | 347/179 |
| 2013/0156458 | A1 * | 6/2013 | Suzuki | 399/81 |
| 2013/0208290 | A1 * | 8/2013 | Ikari | 358/1.12 |

FOREIGN PATENT DOCUMENTS

JP 04-356088 * 12/1992 ..... G03G 21/00

OTHER PUBLICATIONS

U.S. Appl. No. 14/047,320, filed Oct. 7, 2013.

* cited by examiner

*Primary Examiner* — Huan Tran
(74) *Attorney, Agent, or Firm* — Patterson & Sheridan, LLP

(57) ABSTRACT

A decoloring apparatus includes a reading unit that reads a recording medium to generate a read result, a decoloring unit that decolors an image formed on the recording medium, and a control unit that determines a printable area of the recording medium based on the read result of the reading unit, and whether or not the image formed on the recording medium has been decolored.

19 Claims, 6 Drawing Sheets

DECOLORING APPARATUS FOR READING SHEET AFTER DECOLORING IMAGE

FIELD

Embodiments described herein relate generally to a decoloring apparatus which reads a sheet after decoloring an image formed on the sheet.

BACKGROUND

A decoloring apparatus decolors an image formed on a sheet so that the sheet can be reused. The decoloring apparatus reads the sheet after decoloring, and determines whether or not the image formed on the sheet has been effectively decolored.

When a sheet is transported while it is skewed at a time the sheet is read to determine decoloring of an image formed on the sheet, there is a concern that the decoloring apparatus may make an error when determining the effectiveness of the decoloring.

DETAILED DESCRIPTION

In general, according to one embodiment, there is provided a decoloring apparatus including: a reading unit that reads a recording medium to generate a read result; a decoloring unit that decolors an image formed on the recording medium; and a control unit that determines a printable area of the recording medium (referred to as a "sheet area") based on the read result of the reading unit, and whether or not the image formed on the recording medium has been decolored.

Hereinafter, embodiments will be described.

Figure 1:
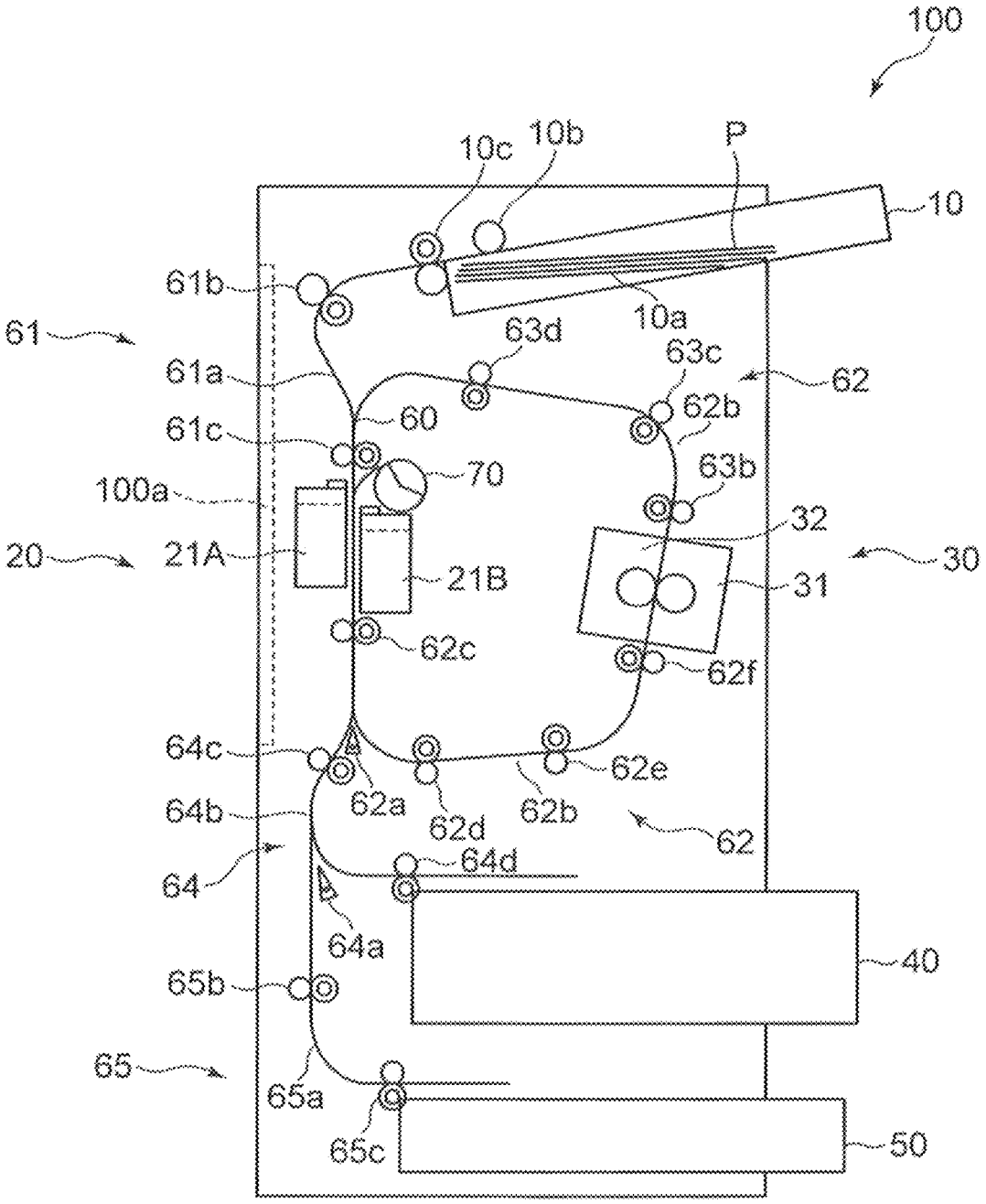
FIG. 1 is a schematic diagram which illustrates a decoloring apparatus according to an embodiment.

FIG. 1 is a schematic diagram which illustrates a decoloring apparatus 100 according to an embodiment. The decoloring apparatus 100 decolors (erases) an image which may be decolored (erased), and which is formed on a sheet P which is a recording medium. The image which may be decolored (erased) is formed using, for example, oil-based decoloring toner. The decoloring toner is toner of which a color is erased (decolored) by being heated, for example. The decoloring apparatus 100 includes a feeding unit 10 of the sheet P, a reading unit 20, a decoloring unit 30, a tray 40 for reusable sheet, a tray 50 for rejected sheet, and a shading unit 70.

The decoloring apparatus 100 includes a first transport unit 61, a second transport unit 62, a third transport unit 64, and a fourth transport unit 65. The first transport unit 61 includes a first transport path 61*a* which extends from the feeding unit 10 to a first branching portion 62*a* via the reading unit 20. The first transport unit 61 includes transport rollers 61*b*, 61*c*, and 62*c* along the first transport path 61*a*. The second transport unit 62 includes a second transport path 62*b* which branches from a branching point at which the first branching portion 62*a* is arranged, and joins the first transport path 61*a* at a junction 60 which is upstream of the reading unit 20.

The decoloring unit 30 includes heating rollers 31 and 32. The decoloring unit 30 is present in the second transport path 62*b*. The second transport path 62*b* includes transport rollers 62*d*, 62*e*, 62*f*, 63*b*, 63*c*, and 63*d* along the second transport path 62*b*. The third transport unit 64 includes a third transport path 64*b* which extends from the first branching portion 62*a* to the tray 40 for reusable sheet via a second branching portion 64*a*. The third transport unit 64 includes transport rollers 64*c* and 64*d* along the third transport path 64*b*. The fourth transport unit 65 includes a fourth transport path 65*a* which extends from the second branching portion 64*a* to the tray 50 for rejected sheet. The fourth transport unit 65 includes transport rollers 65*b* and 65*c* along the fourth transport path 65*a*.

The second transport unit 62 causes the sheet P which is transported from the reading unit 20 to be transported in the direction of the reading unit 20 again via the decoloring unit 30. The feeding unit 10 includes, for example, a feeding tray 10*a*, a pickup roller 10*b*, and a separating roller 10*c*.

Figure 2:
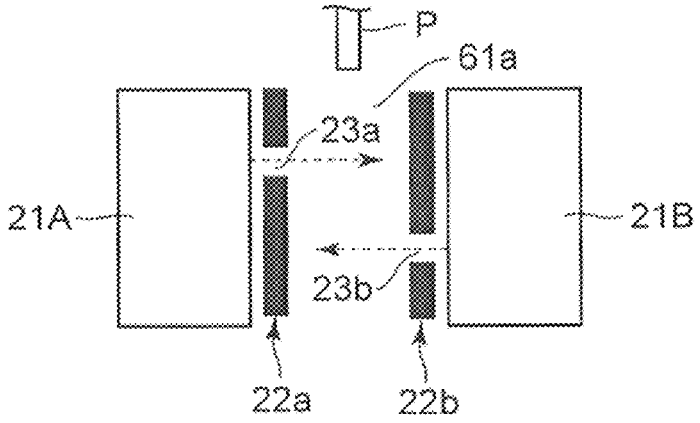
FIG. 2 is a schematic diagram which illustrates a reading unit according to the embodiment.

The reading unit 20 includes a first scanner 21A and a second scanner 21B. As illustrated in FIG. 2, the first and second scanners 21A and 21B face each other and have the first transport path 61*a* interposed therebetween. The reading unit 20 includes black transport guides 22*a* and 22*b*. By setting the transport guides 22*a* and 22*b* to black colors, it is possible to easily determine ripping or folding of the sheet P which passes through the first transport path 61*a*. The first and second scanners 21A and 21B read the sheet P at positions of slits 23*a* and 23*b* which are formed in the transport guides 22*a* and 22*b*, respectively.

The shading unit 70 is used when correcting shading of the first and second scanners 21A and 21B. A CPU 101 corrects shading of a read image using data which is obtained by reading a shading plate of the shading unit 70 by the first and second scanners 21A and 21B.

The decoloring unit 30 decolors an image which is formed on the sheet P, and which may be decolored (erased) by heating the sheet P. The decoloring unit 30 heats the sheet to a toner decoloring temperature at which the decoloring toner is decolored or higher. The decoloring toner is formed by causing a binder resin to contain a coloring material, a coloring compound, and a color developer. When a printed image which is formed using the decoloring toner is heated to the toner decoloring temperature or higher, the printed image is decolored (erased) due to a separation of the coloring compound and the color developer from each other in the decoloring toner.

The tray 40 for reusable sheet stacks a sheet P which is reusable after decoloring an image. The tray 50 for rejected sheet stacks a sheet P which is determined to be not reusable.

Figure 3:
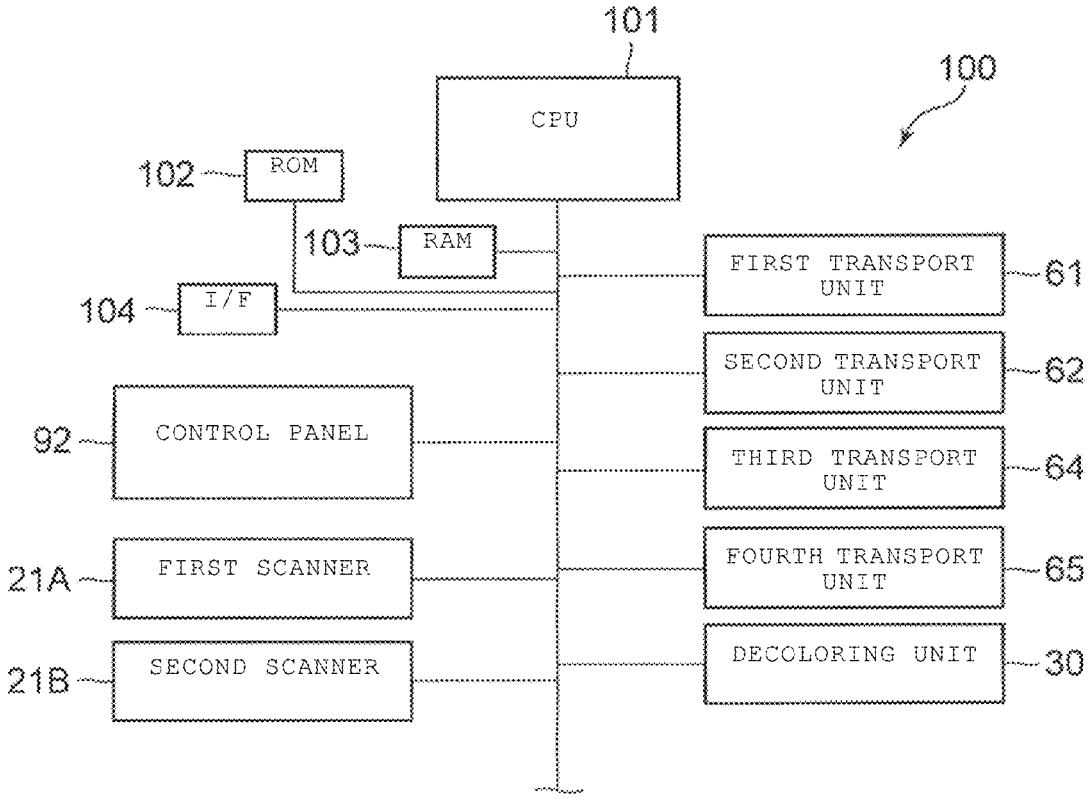
FIG. 3 is a block diagram which illustrates the decoloring apparatus according to the embodiment.

A processor (CPU) 101, which implements functions of a control unit, is illustrated in the block diagram in FIG. 3 and controls the decoloring apparatus 100. The decoloring apparatus 100 includes a Read Only Memory (ROM) 102 which stores various control programs, and a Random Access Memory (RAM) 103 which provides a temporary work area.

The CPU 101 controls an interface (I/F) 104 which is connected to an external device. The CPU 101 controls a control panel 92 which includes a display unit, a control button, or the like. The CPU 101 controls the first and second scanners 21A and 21B. The CPU 101 controls the first transport unit 61, the second transport unit 62, the third transport unit 64, and the fourth transport unit 65. The CPU 101 controls the decoloring unit 30.

The CPU 101 determines, for example, a sheet area, a printed area, or an area of the transport guides 22*a* and 22*b* from an image which is read using the first scanner 21A or the second scanner 21B. The CPU 101 compares characteristics of the image which is read using the first scanner 21A or the second scanner 21B with characteristics of a reference image, and determines whether the image is in the sheet area, in the printed area, or in the area of the transport guides 22*a* and 22*b*. The CPU 101 determines whether or not the image which is formed on the sheet P is decolored, for example, from the image which is read using the first scanner 21A or the second scanner 21B.

The decoloring apparatus 100 starts a decoloring operation of an image which is formed on the sheet P placed on the feeding tray 10*a* according to an instruction of decoloring from the control panel 92, for example. The decoloring apparatus 100 reads the sheet P which is fed from the feeding unit 10 using the first scanner 21A and the second scanner 21B, and decolors an image on the sheet P using the decoloring unit 30. The decoloring apparatus 100 reads the sheet P after decoloring an image thereon again using the first scanner 21A and the second scanner 21B, and determines whether or not the image is erased. The decoloring apparatus 100 discharges the sheet P of which the image is erased, and which may be reused to the tray 40 for reusable sheet. The decoloring apparatus 100 discharges the sheet P of which the image is not erased, and which cannot be reused to the tray 50 for rejected sheet.

The first scanner 21A and the second scanner 21B read an area corresponding to a sheet size which is instructed in the control panel 92, for example, when the sheet P is read. However, when the sheet P which passes through the first transport path 61*a* is skewed, there is a case in which the first scanner 21A and the second scanner 21B read the black transport guides 22*a* and 22*b* on the back side of the sheet P.

When the sheet P is skewed, in a case where determination on decoloring is made with respect to the entire region, the CPU 101 makes an error in determining that the image has not been decolored, even when the image has been decolored in the decoloring unit 30. The reason is that the CPU 101 determines portions of the black transport guides 22*a* and 22*b* on the back side of the sheet P to be remains of decoloring an image, and makes an error in the decoloring determination. According to the embodiment, in order to prevent the determination error in which the portions of the black transport guides 22*a* and 22*b* are determined to be the remains of decoloring an image, the decoloring determination is made only for the sheet area. According to the embodiment, the CPU 101 performs the decoloring determination with respect to the sheet area that excludes the transport guides 22*a* and 22*b* from an image which is read using the first scanner 21A or the second scanner 21B.

The decoloring determination processes of an image on the sheet using the first scanner 21A or the second scanner 21B are illustrated in FIGS. 4 to 9. The CPU 101 reads the sheet P which passes through the first transport path 61*a* using the first scanner 21A or the second scanner 21B, determines a type of a read image, and determines whether or not the image has been decolored after a decoloring process.

Figure 4:
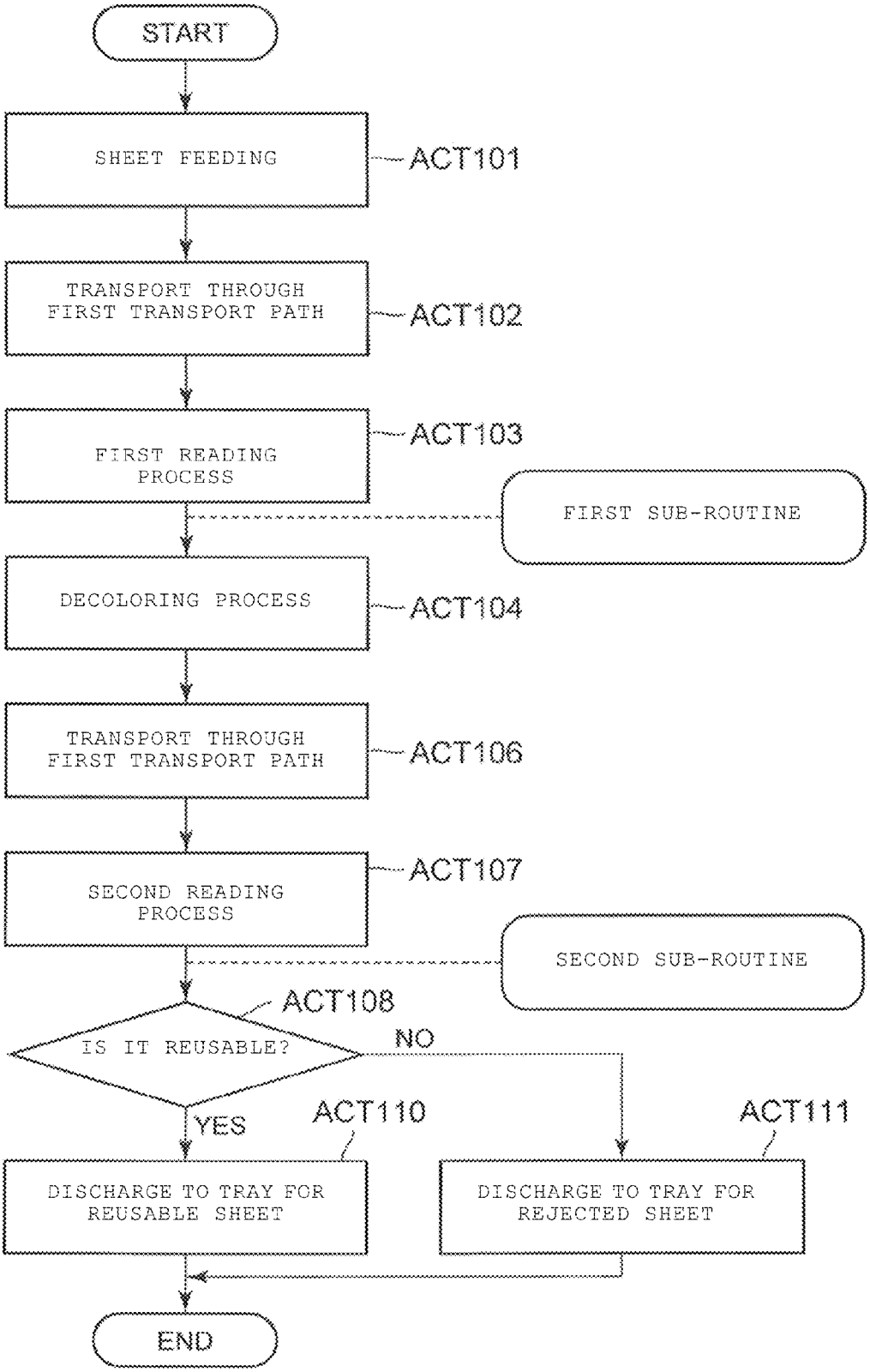
FIG. 4 is a flowchart of a method for determining whether or not an image has been decolored in the decoloring apparatus, according to an embodiment.

FIG. 4 is a flowchart of a method for determining whether or not an image has been decolored in the decoloring apparatus 100. When a decoloring operation of an image is started, the CPU 101 instructs the feeding unit 10 to feed the sheet P (ACT 101). The CPU 101 instructs the first transport unit 61 to perform transporting of the sheet P through the first transport path 61*a* (ACT 102). The CPU 101 instructs the reading unit 20 to perform a first reading process on the sheet P (ACT 103). The reading unit 20 reads a first face and a second face of the sheet P using the first scanner 21A and the second scanner 21B, respectively.

When it is determined from a read image obtained in the first reading process in ACT 103, that the sheet P is ripped or folded, the CPU 101 instructs the fourth transport unit 65 to discharge the sheet P to the tray 50 for rejected sheet. When it is determined from the read image that the sheet P is not ripped or folded, and may be reused, the CPU 101 proceeds to ACT 104.

Figure 5:
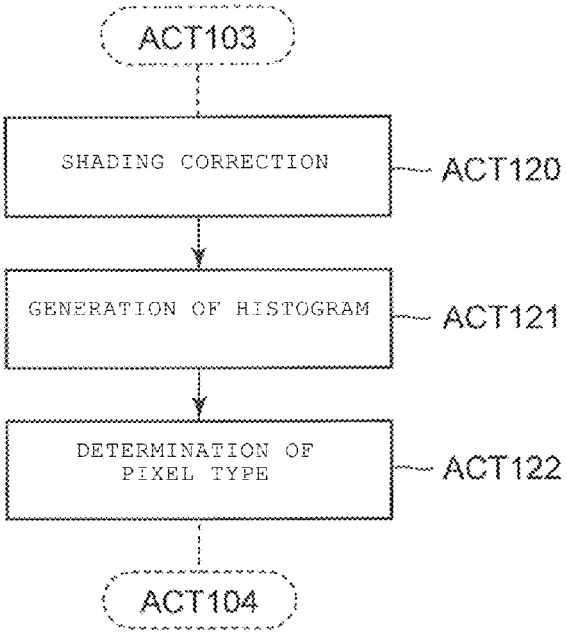
FIG. 5 is a flowchart of a method for determining a type of pixels in a read image, according to an embodiment.

The CPU 101 determines the type of pixels from the read image of one page which is obtained in the first reading process in ACT 103 by performing a first sub-routine which is illustrated in the flowchart in FIG. 5. The CPU 101 performs a shading correction of the read image (ACT 120), and generates a histogram of the read image (ACT 121). For example, when the sheet P is A4-size paper, the CPU 101 generates a histogram using the number of pieces of data corresponding to 7024 pixels×4960 pixels, in ACT 121. The size of the sheet P is not limited.

Figure 6:
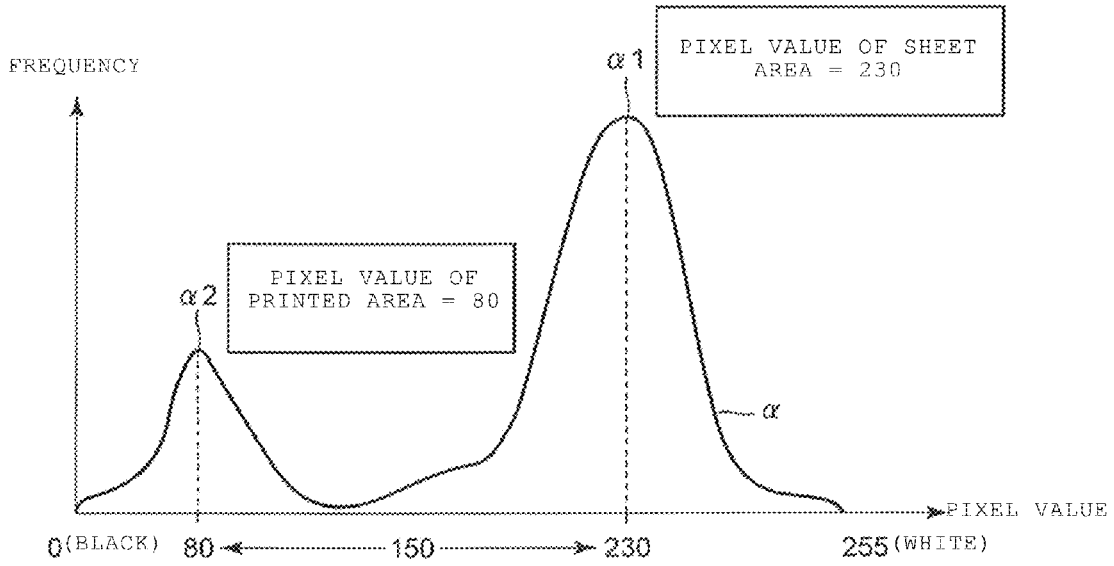
FIG. 6 is a graph which illustrates a histogram of one page of a sheet which is not skewed in the decoloring apparatus according to the embodiment.

For example, when the read image is an image which is printed using blue decoloring toner, and which is obtained by reading the sheet P of A4 size which is not skewed, the CPU 101 generates in ACT 121 a histogram α which is illustrated in FIG. 6.

The CPU 101 determines a pixel signal value 230 of a first peak α1 with the highest frequency to be a signal value corresponding to the sheet area from the histogram α in FIG. 6. The CPU 101 determines a pixel signal value 80 of a second peak α2 with the second highest frequency to be a signal value corresponding to an area which is printed using, for example, the blue decoloring toner on the sheet P from the histogram α in FIG. 6. In the histogram α in a case of reading the sheet P which is not skewed, two peaks of the first peak α1 corresponding to the sheet area and the second peak α2 corresponding to the printed area appear.

The CPU 101 determines an area which is printed using the blue decoloring toner from a difference with the pixel signal value 230 of the sheet area. As illustrated in FIG. 6, when the peak pixel signal value of the area which is printed using the blue decoloring toner is 80, and the pixel signal value of the sheet area is 230, the CPU 101 determines a pixel signal value of which a difference between the pixel signal value of the sheet area is in a range of, for example, 120 to 180 to be a signal value corresponding to the area which is printed using the blue decoloring toner.

The CPU 101 determines the pixel of which the pixel signal value 230 to be the sheet area, and the pixel of which the pixel signal value is 80 to be the printed area (ACT 122), and ends the first sub-routine.

Figure 7:
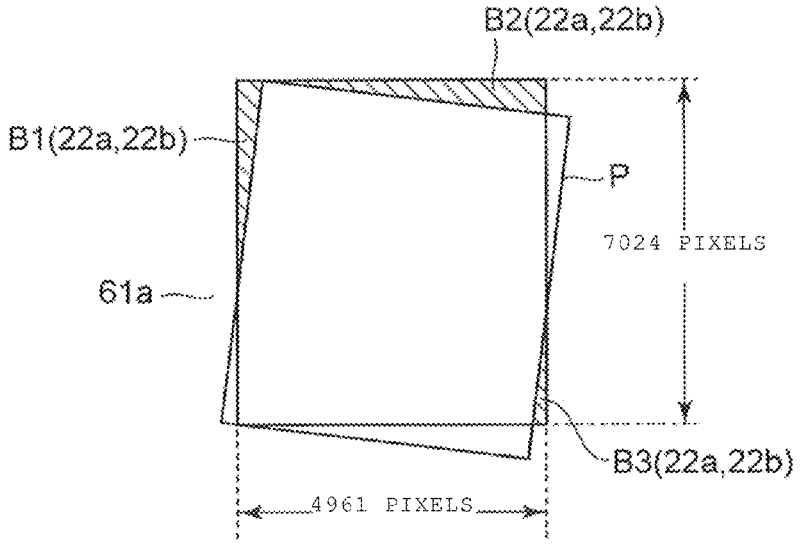
FIG. 7 illustrates an image which is read by a scanner when a sheet is skewed in the decoloring apparatus according to the embodiment.

When the sheet P of A4 size which is printed using the blue decoloring toner is skewed, the reading unit 20 reads the sheet P which passes through the first transport path 61*a* as illustrated in FIG. 7. When the sheet P is skewed, areas of B1, B2, and B3 which are denoted by slanting lines in the read area (7,024 pixels×4,960 pixels) become areas of the black transport guides 22*a* and 22*b*.

Figure 8:
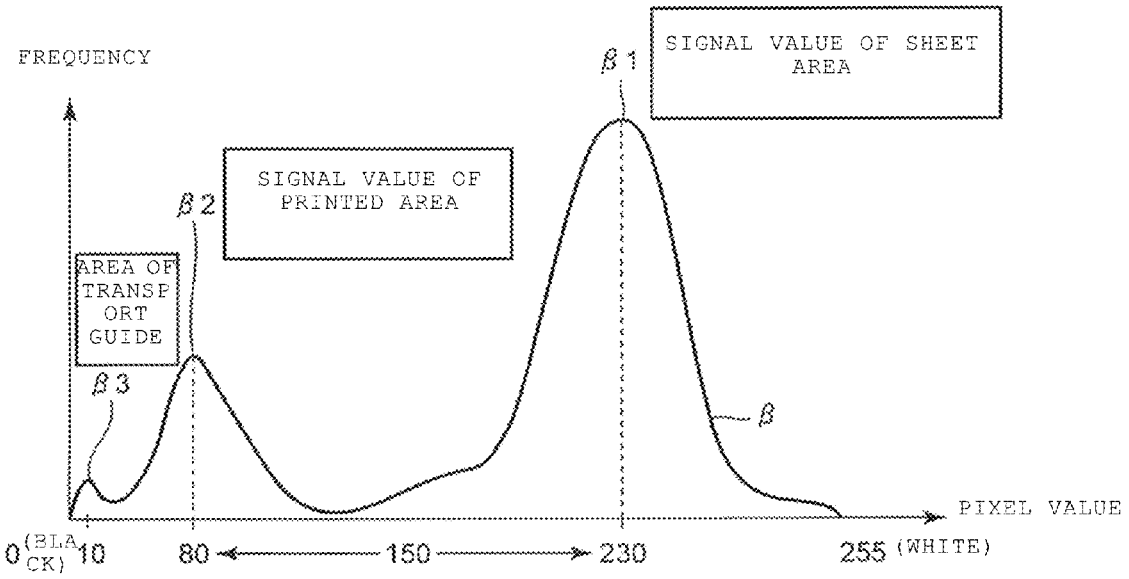
FIG. 8 is a graph which illustrates a histogram of one page of a sheet which is skewed in the decoloring apparatus according to the embodiment.

As illustrated in FIG. 7, when the skewed sheet P is read, the CPU 101 generates a histogram β which is illustrated in FIG. 8 from the read image 1 in ACT 121. The CPU 101 determines a pixel signal value 230 of a first peak β1 with the highest frequency to be a signal value corresponding to the sheet area from the histogram β in FIG. 8. The CPU 101 determines a pixel signal value 80 of a second peak β2 with the second highest frequency in the histogram β in FIG. 8 to be a signal value corresponding to a printed area using the blue decoloring toner on the sheet P. The CPU 101 determines a pixel signal value 10 of a third peak β3 with the third highest frequency in the histogram β in FIG. 8 to be a signal value corresponding to the area of the transport guides 22*a* and 22*b*. In the histogram β in a case of reading the skewed sheet P, three peaks of the first peak β1 corresponding to the sheet area, the second peak β2 corresponding to the printed area, and the peak β3 corresponding to the area of the transport guides appear.

The CPU 101 determines the area which is printed using the blue decoloring toner, and the area of the transport guides from a difference with the pixel signal value 230 of the sheet area. As illustrated in FIG. 8, when a peak pixel signal value of the area of the transport guides is 10, a peak pixel signal value of the area printed using the blue decoloring toner is 80, and a peak pixel signal value of the sheet area is 230, the CPU 101 determines a pixel signal value of which a difference with the pixel signal value of the sheet area is, for example, equal to or greater than 210 to be a signal value corresponding to the area of the transport guides, and determines a pixel signal value of which a difference with the pixel signal value of the sheet area is, for example, in a range of 120 to 180 to be a signal value corresponding to the area which is printed using the blue decoloring toner.

When the pixel signal value 230 is the sheet area, the pixel signal value 80 is the printed area, and the pixel signal value 10 is the area of the transport guides 22*a* and 22*b*, the CPU 101 determines the type of the pixel (ACT 122), and ends the first sub-routine.

When it is determined that the sheet P is not ripped or folded, and may be reused from the read image obtained in the first reading process in ACT 103, the CPU 101 proceeds to ACT 104. In ACT 104, the CPU 101 instructs the second transport unit 62 to transport the sheet P, instructs the decoloring unit 30 to decolor an image, and performs a decoloring process of the image. After decoloring the image, the CPU 101 instructs the first transport unit 61 to transport the sheet P through the first transport path 61*a* (ACT 106). The CPU 101 instructs the reading unit 20 to perform a second reading process (ACT 107). The reading unit 20 reads the first and second faces of the sheet P using the first scanner 21A and the second scanner 21B, respectively.

The CPU 101 determines whether or not the sheet P may be reused depending on whether or not the image on the sheet P is decolored, from the read image obtained in the second reading process in ACT 107 (ACT 108). However, when the sheet P is skewed on the first transport path 61*a*, the reading unit 20 reads the black transport guides 22*a* and 22*b* at the periphery of the sheet P. The read image which is obtained in ACT 107 includes images in the black regions B1, B2, and B3 which are transport guides 22*a* and 22*b*, for example.

When the sheet P is skewed, the read image obtained in the second reading process includes the images in the black regions B1, B2, and B3, even when the image formed on the sheet P is decolored. When the read image obtained in the second reading process includes the images in the black regions B1, B2, and B3, the CPU 101 may erroneously determine that the image is not decolored. The CPU 101 determines the sheet area and the area of the transport guides 22*a* and 22*b* using the read image obtained in the second reading process, in order to properly determine that the image is decolored even when the sheet P is skewed. The CPU 101 determines whether or not the image is decolored only in the sheet area, excluding the area of the transport guides 22*a* and 22*b* from the read image obtained in the second reading process.

Figure 9:
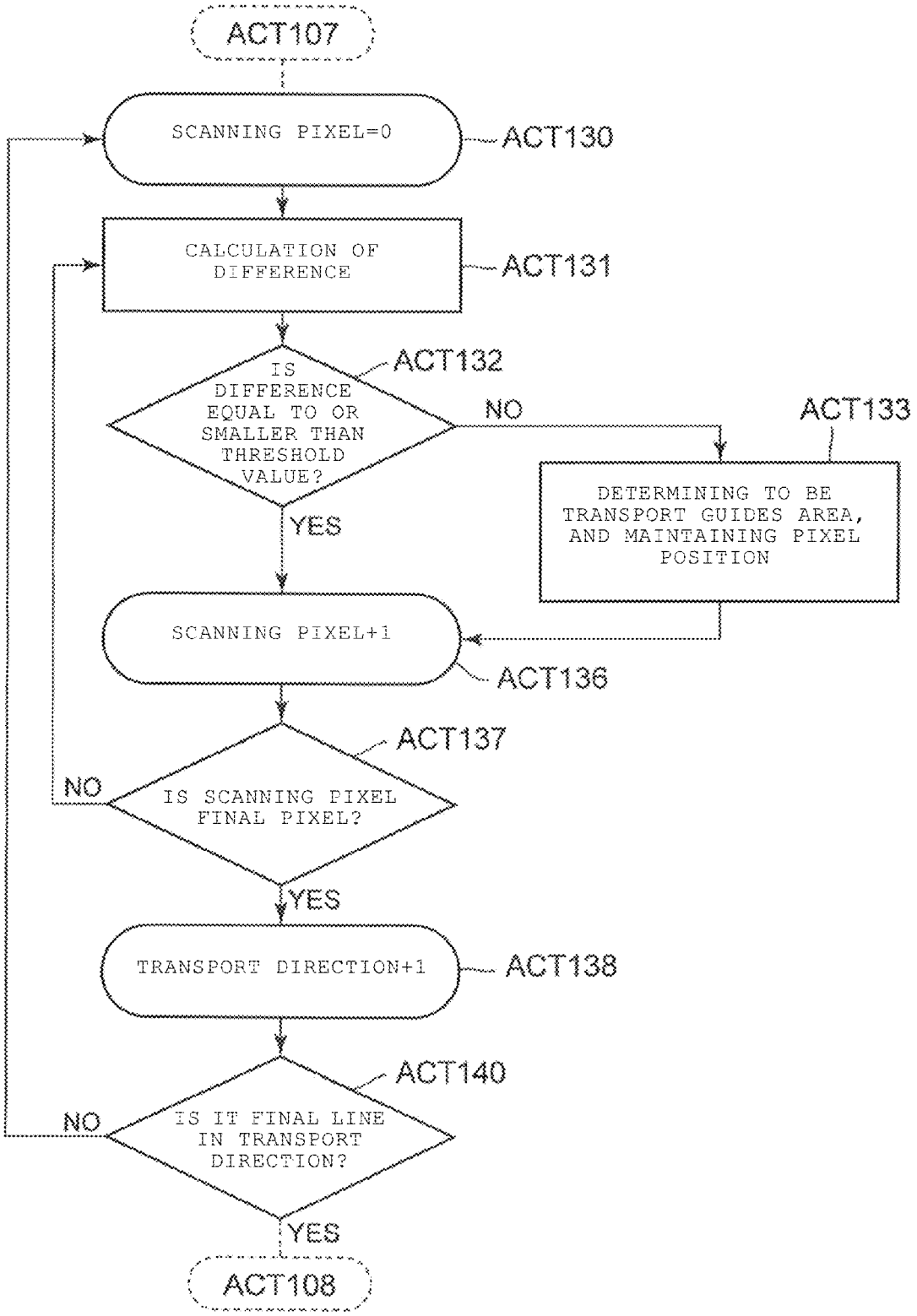
FIG. 9 is a flowchart of a method for determining a region of a sheet from a read image, according to an embodiment.

The CPU 101 performs a second sub-routine which is illustrated in a flowchart in FIG. 9 in order to properly determine that the image is decolored even when the sheet P is skewed. The CPU 101 distinguishes the area of the sheet P from the area of transport guides 22*a* and 22*b* using the read image of one page which is obtained in the second reading process in ACT 107. The second sub-routine is a flowchart of a method for determining an area excluding the pixel signal value 10 which is obtained from the histogram β (signal value corresponding to an area of transport guides 22*a* and 22*b*) which is illustrated in FIG. 8 to be the area of the sheet P.

The CPU 101 reads a scanning pixel 0 on the first line of the read image obtained in ACT 107 (ACT 130). The CPU 101 calculates a difference between the pixel signal value of the scanning pixel 0 and the pixel signal value 230 (pixel signal value of sheet area) (ACT 131). When the difference between the pixel signal value of the scanning pixel and the pixel signal value of sheet area is equal to or smaller than a predetermined threshold value (for example, 150) (Yes in ACT 132), the CPU 101 determines the pixel to be a pixel in the area of the sheet P, and reads the subsequent pixel of the read image (ACT 136).

When the difference which is calculated in ACT 131 is larger than the predetermined threshold value (No in ACT 132), the CPU 101 proceeds to ACT 133. In ACT 133, The CPU 101 determines that the pixel is a pixel in the area of transport guides 22*a* and 22*b*, stores the pixel position corresponding to the area of transport guides 22*a* and 22*b* in the RAM 103 (ACT 133), and proceeds to ACT 136.

The subsequent pixel of the read image is read in ACT 136, and the CPU 101 determines whether or not the scanning pixel is the final pixel (ACT 137). The CPU 101 repeats ACT 131, ACT 132, ACT 133, ACT 136, and ACT 137 until the scanning pixel becomes the final pixel (Yes in ACT 137). When the scanning pixel becomes the final pixel (Yes in ACT 137), the CPU 101 proceeds to the subsequent line in the transport direction (ACT 138).

The CPU 101 repeats ACT 130, ACT 131, ACT 132, ACT 133, ACT 136, ACT 137, ACT 138, and ACT 140 until the final line in the transport direction is reached (Yes in ACT 140). When the final pixel in the final line in the transport direction of the read image is reached (Yes in ACT 140), the CPU 101 ends the method for determining the area of all pixels of one page. When determining of the area of the entire pixel of one page is ended, all of pixel positions corresponding to the area of transport guides 22*a* and 22*b* are stored in the RAM 103. The CPU 101 ends the second sub-routine, and proceeds to ACT 108 illustrated in FIG. 4.

The CPU 101 determines whether or not images on the first and second faces of the sheet P are decolored in ACT 108. The determination on whether or not the images are decolored is performed only in the sheet area excluding the area of the transport guides 22*a* and 22*b* which is stored in the RAM 103 due to the second sub-routine. When the image is decolored in the sheet area, which excludes the area of the transport guides 22*a* and 22*b* of the read image 2, the CPU 101 determines that the sheet P may be reused (Yes in ACT 108). When it is "Yes"

in ACT 108, the CPU 101 discharges the sheet P to the tray 40 for reusable sheet (ACT 110), and ends the decoloring determining process of an image.

When the image in the sheet area, which excludes the area of the transport guides 22*a* and 22*b* of the read image 2 is not decolored, the CPU 101 determines that the sheet P cannot be reused (No in ACT 108). When it is "No" in ACT 108, the CPU 101 discharges the sheet P to the tray 50 for rejected sheet (ACT 111), and ends the decoloring determining process of the image. A user takes the sheet P in the tray 40 for reusable sheet out, and reuses the sheet. A user recycles, or disposes the sheet in the tray 50 for rejected sheet.

According to the embodiment, the CPU 101 determines the sheet area, the printed area, or the area of the transport guides 22*a* and 22*b* from the pixel signal values of the read image. The CPU 101 calculates a difference between signal values of all pixels of the read image after the decoloring process and a signal value of the sheet area, and stores pixel positions corresponding to the area of the transport guides 22*a* and 22*b* in the RAM 103. The CPU 101 performs decoloring determination of the image in the sheet area that excludes the area of the transport guides 22*a* and 22*b* of the read image 2 after the decoloring process. According to the embodiment, even when the sheet P is skewed, the CPU 101 may determine decoloring of the image only in the sheet P area. When the sheet P is skewed, the CPU 101 prevents the area of the transport guides 22*a* and 22*b* from also being included in the decoloring determination of the image. A determination error determining that the image is not decolored with respect to the area of the transport guides 22*a* and 22*b*, when the sheet P is skewed, is prevented, and precision of decoloring determination using the CPU 101 is improved.

The decoloring apparatus is not limited in the embodiment, and, for example, a size of the sheet to be decolored is not limited, and is arbitrary such as an A5 size, a B4 size, a letter size, or the like. In order to prevent a sheet on which a toner image is fixed using heat from adhering onto a discharge tray in an image forming apparatus, adhering of a sheet on the discharge tray may be predicted. In addition, a structure, or the like, of the reading unit is also arbitrary, and for example, a structure in which one scanner is provided, and the first and second faces of the sheet are read by switching back the sheet, or the like, may be also possible. In addition, a material, a color, or the like, of the transport guide is not limited when it is possible to determine that the area thereof is different from the sheet area, or the printed area.

While certain embodiments have been described, these embodiments have been presented by way of example only, and are not intended to limit the scope of the inventions. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A decoloring apparatus comprising:

a reading unit configured to read a recording medium to generate a read result;

a decoloring unit configured to decolor an image formed on the recording medium; and a control unit configured to determine a printable area of the recording medium based on the read result of the reading unit, and whether or not the image formed on the recording medium has been decolored.

2. The apparatus according to claim 1, wherein the read result includes a plurality of pixels and the control unit is configured to determine a printable area of the recording medium based on signal values of the pixels.

3. The apparatus according to claim 2, wherein the control unit is configured to determine a first signal value range for pixels in the printable area, and a second signal value range, that is lower than the first signal value range, for pixels in a non-printable area of the recording medium.

4. The apparatus according to claim 3, wherein the control unit is configured to determine whether or not the image formed on the recording medium has been decolored by examining signal values of the pixels that are in the printable area.

5. The apparatus according to claim 3, wherein the control unit is configured to examine signal values of all pixels, determine the printable area having a first signal value range based on the signal values of pixels, and determine whether or not the image formed on the recording medium has been decolored by comparing signal values of the pixels in the printable area, and not the pixels in the non-printable area, with a reference signal value.

6. The apparatus according to claim 5, wherein the printable area includes a first portion including the image formed on the recording medium and a second portion where no image is formed.

7. The apparatus according to claim 1, wherein the image is formed on the recording medium using a decolorable toner.

8. A method of determining whether or not an image formed on a recording medium has been decolored, comprising:

reading the recording medium to generate a first read result;

determining a signal value range for an image on the recording medium based on the first read result of the reading unit;

decoloring the image formed on the recording medium; and after the decoloring, reading the recording medium to generate a second read result, and determining whether or not the image formed on the recording medium has been decolored based on the signal value range of the first and a signal value of second read results.

9. The method according to claim 8, wherein each of the first and second read results includes a plurality of pixels and signal values of the pixels are used to determine whether or not the image formed on the recording medium has been decolored.

10. The method according to claim 9, wherein the signal value range of the first read result is a first signal value range, and the method further comprising:

determining a printable area by identifying all pixels having a signal value in the first signal value range, determining a non-printable area by identifying all pixels having a signal value outside the first signal value range.

11. The method according to claim 10, wherein the signal values of the pixels in the printable area are examined to determine whether or not the image formed on the recording medium has been decolored.

12. The method according to claim 10, wherein the signal values of the pixels in the printable area, and not the pixels that in the non-printable area, are compared with a reference signal value to determine whether or not the image formed on the recording medium has been decolored.

13. The method according to claim 10, wherein the first printable area includes a first portion including the image formed on the recording medium and a second portion where no image is formed.

14. The method according to claim 8, wherein the image is formed on the recording medium using a decolorable toner.

15. A sheet skew determination device comprising:

a reading unit configured to read a sheet to generate a read result, the read result containing a plurality of pixels with different signal values;

a control unit configured to determine that a printable area of the sheet has been skewed based on the signal values of the pixels; and a memory that stores positions of the pixels of the read result that are determined to be outside the printable area.

16. The device according to claim 15, wherein the control unit is configured to determine a first signal value range for the pixels that are in the printable area, and a second signal value range, that is lower than the first signal value range, for the pixels that are outside the printable area.

17. The device according to claim 16, wherein the control unit is configured to examine the signal value of each of the pixels and determine whether or not the pixel lies in or outside the printable area.

18. The device according to claim 17, wherein the control unit is configured to determine that the pixel lies in the printable area if the signal value of the pixel lies in the first signal value range and outside the printable area if the signal value of the pixel lies in the second signal value range.

19. The device according to claim 15, wherein the printable area includes an image formed on the sheet using decolorable toner.

* * * * *